United States Patent [19]

Möltner et al.

[11] Patent Number: 4,571,970

[45] Date of Patent: Feb. 25, 1986

[54] ROLLING MILL PLANT FOR THE MANUFACTURE OF SEAMLESS TUBES

[75] Inventors: Hermann Möltner, Grevenbroich; Karl-Hans Staat, Homberg, both of Fed. Rep. of Germany

[73] Assignee: Kocks Technik GmbH & Co., Hilden, Fed. Rep. of Germany

[21] Appl. No.: 672,116

[22] Filed: Nov. 16, 1984

Related U.S. Application Data

[63] Continuation of Ser. No. 411,582, Aug. 25, 1982, abandoned.

[30] Foreign Application Priority Data

Sep. 14, 1981 [DE] Fed. Rep. of Germany ..... 3136381

[51] Int. Cl.[4] ..... B21B 15/00; B21B 19/06; B21C 45/00

[52] U.S. Cl. ..... 72/68; 72/97; 72/96; 72/209

[58] Field of Search ..... 72/96, 97, 208, 209, 72/68

[56] References Cited

U.S. PATENT DOCUMENTS

| | | | |
|---|---|---|---|
| 1,867,120 | 7/1932 | Vollmer | 72/97 |
| 1,936,790 | 11/1933 | Heetkamp | 72/97 |
| 2,010,400 | 8/1935 | Klein | 72/97 |
| 2,024,514 | 12/1935 | Diescher | 72/97 |
| 3,857,267 | 12/1974 | Lemaire et al. | 72/209 |
| 4,037,449 | 7/1977 | Schuetz | 72/234 |
| 4,212,178 | 7/1980 | Bretschneider | 72/97 |
| 4,311,032 | 1/1982 | Nessi . | |
| 4,318,294 | 3/1982 | Yoshiware et al. | 72/97 |

FOREIGN PATENT DOCUMENTS

| | | | |
|---|---|---|---|
| 1427915 | 1/1973 | Fed. Rep. of Germany | 72/96 |
| 149708 | 11/1980 | Japan | 72/97 |

*Primary Examiner*—Lowell A. Larson

*Attorney, Agent, or Firm*—Buell, Ziesenheim, Beck & Alstadt

[57] ABSTRACT

In a rolling mill plant for the manufacture of seamless tubes, a piercing mill (2), a planetary skew rolling mill (15) and a sizing or stretch-reducing rolling mill (18) are arranged one after the other. In order to improve the output and the quality of the products of plant of this kind, it is proposed not to withdraw the shaft rods (11) used during the piercing operation in the mill (2), but also to use them as internal tools in the planetary skew rolling mill (15). The shaft rods can then remain at the entry end upstream of the planetary skew rolling mill (15) from where they can be returned to the piercing mill (2). Alternatively (FIGS. 2 and 4) they can also pass through the planetary skew rolling mill and be returned from the delivery end thereof to the piercing mill. The insertion, hitherto required, of rods into the hollow ingots before entering the planetary skew rolling mill is not required. The heavy scaling of the surface of the bore in the hollow ingot thereby occurring is avoided.

17 Claims, 6 Drawing Figures

ROLLING MILL PLANT FOR THE MANUFACTURE OF SEAMLESS TUBES

This application is a continuation of my copending application Ser. No. 411,582, filed Aug. 25, 1982 abandoned.

DESCRIPTION

The invention relates to a rolling mill plant for the manufacture of seamless tubes in which a piercing mill, a planetary skew rolling mill and a sizing or stretch-reducing rolling mill are arranged one after the other.

In a known plant of this kind, as described in German Patent Specification (Auslegeschrift) No. 26 57 823, shaft rods used to support the piercer in the piercing mill are withdrawn from the hollow ingots beyond the piercing mill, and are re-used for the following ingots in the piercing mill. Each hollow ingot without its shaft rod is conveyed by longitudinal and transverse conveying devices to a depositing table of the planetary skew rolling mill where a mandrel rod is first inserted into the opening in the hollow ingot. The protruding leading end portion of the mandrel rod extends into the sizing pass opening of the planetary skew rolling mill where it is axially fixed by virtue of the trailing end portion being held fast. The hollow ingot is then advanced along the mandrel rod into the sizing pass opening of the planetary skew rolling mill and is cogged down over the leading end portion of the mandrel rod. The stretch-reducing mill is located a short distance beyond the planetary skew rolling mill coaxially therewith, and the tubular bloom produced in the planetary skew rolling mill runs directly into the stretch-reducing mill in which it is shaped to form the finished tube.

In this known plant, output is greatly impaired by the operation for changing the mandrel rods upstream of the planetary skew rolling mill, this being the case particularly when processing short hollow ingots. The withdrawal of the previous mandrel rod out of the planetary skew rolling mill, the releasing of the connections for the cooling water and the mandrel rod advancing means, the lateral conveying of the mandrel rod out of the rolling axis, the placing of the following mandrel rod into the rolling axis, the coupling of the cooling water connection and the advancing means, the insertion of the mandrel rod into the hollow ingot and the insertion of the mandrel rod and the hollow ingot into the planetary skew rolling mill, involve a relatively long period of time and thus limit the output. Moreover, a relatively large amount of clearance is required between the external diameters of the mandrel rods and the diameters of the holes in the hollow ingots in order to enable trouble-free insertion of the mandrel rods into the hollow ingots. This large amount of clearance is detrimental to the quality of the interior surface of the tube. Furthermore, only two mandrel rods are used alternately, so that the inspection and maintenance of the mandrel rods always have to be performed under pressure of time and are therefore frequently inadequate. The mandrel rods have to be exchanged if damage or wear then occurs. Such changing of the mandrel rods creates different rolling conditions as a result of slight dimensional differences, so that differing tubular blooms and tubes are produced. Moreover, air is sucked into the hole in the hollow ingot when withdrawing the shaft rod beyond the piercing mill, thus leading to scaling of the wall of the hole.

An object of the invention is to provide a rolling mill plant of the kind mentioned initially which increases output as a result of shorter station times and by which the quality of the work-material can be improved with reduced scaling of the interior surface of the tube.

The present invention resides in a rolling mill plant for the manufacture of seamless tubes, in which a piercing mill, a planetary skew rolling mill and a sizing or stretch-reducing rolling mill are disposed one after the other, and are arranged so that each shaft rod used in the piercing mill, is freed from its piercer and remains in the hollow ingot to serve as a mandrel rod in that ingot for the planetary skew rolling mill, conveying means being provided for returning the shaft rods from the planetary skew rolling mill to the piercing mill after the hollow ingot has been reduced in the planetary skew rolling mill.

The result of this is, in the first instance, that rods do not have to changed between the piercing mill and the planetary skew rolling mill and, consequently, the scaling of the interior wall otherwise caused by this is avoided as well as the loss of time which otherwise occurs. Moreover, the hollow ingot only covers a short distance between the piercing mill and the planetary skew rolling mill and does not again come into contact with a fresh, cool rod, so that there is only a small loss of heat and the rolling temperature is maintained. Furthermore, all problems associated with the introduction of the mandrel rods into the hollow ingots upstream of the planetary skew rolling mill are avoided. Therefore, only a minimum amount of clearance is required between the outer surfaces of the mandrel rods and the interior surfaces of the holes in the hollow ingots, even in the case of hollow ingots of maximum length. This has a positive effect on the quality of the interior surface of the tubes. For this reason, the draw-in portions of the skew rolls of the planetary skew rolling mill can also be kept short, this also being a significant saving which would not be possible in the case of a larger amount of clearance between the mandrel rods and the hollow ingots. The smaller amount of out-of-roundness of the hollow ingot also resulting from the smaller amount of clearance during deformation in the region of the draw-in portions of the skew rolls leads to an improved interior surface of the tubular blooms or tubes. A further reason for this is that the region of the deformation of the hollow is shorter, that is to say, the region in which the wall of the tube is reduced, without the interior of the wall of the tube coming into contact with the surface of the rod. Furthermore, in the plant in accordance with the invention, it is readily possible to use a larger number of shaft rods, so that it is no longer necessary to service and maintain them under considerable pressure of time. The wear on an individual shaft rod is also less when a large number of shaft rods is used, since it is used less frequently per tonne of work-material produced and it is better maintained.

In an advantageous embodiment of the invention, the shaft rods remain at the entry end of the planetary skew rolling mill and are returnable from this location to the piercing mill. The distance between the planetary skew rolling mill and the stretch-reducing rolling mill can thereby be kept extremely short. Since the rods are then free from the hollow ingot, the rods can, if necessary, be returned to the piercing mill over a longer path according to the local conditions, so that the short path for the work-material is kept free.

In another embodiment of the invention, the shaft rods together with the work-material are moveable in the planetary skew rolling mill from the entry end to the delivery end through the sizing pass opening and are returnable from the delivery end of the planetary skew rolling mill to the piercing mill. It is thereby possible to hold the shaft rods at the commencement of the rolling operation and to allow them to pass through the planetary skew rolling mill together with the rest of the work-material only at the end of each individual rolling operation. Alternatively, however, the shaft rod can be allowed to pass through the sizing pass opening together with the rest of the work-material at the commencement of each rolling operation, although it is thereby possible to decelerate the shaft rod such that the trailing end portion of the work-material passes through the sizing pass opening of the planetary skew rolling mill in advance of the trailing end portion of the shaft rod, so that deformation of the hollow cannot occur. In both cases, the shaft rod is removed from the tubular bloom only in the region between the planetary skew rolling mill and the stretch-reducing rolling mill. A large amount of space is thereby saved at the entry end of the planetary skew rolling mill, since the device for retracting the rods and for returning the shaft rods to the piercing mill is not provided at this location, which, according to local conditions, can be very advantageous.

In the last-mentioned embodiment of the invention, it is advantageous for the planetary skew rolling mill to have a separate arrangement, such as drive rollers, for complete conveyance of the shaft rods towards the delivery end. Since the diameter of the sizing pass opening formed by the skew rolls is larger than the diameter of the shaft rods without work-material, the skew rolls can no longer completely convey the trailing end portions of the shaft rods through the planetary skew rolling mill to the delivery end, so that this operation has to be assisted by means of, for example, radially adjustable drive rollers. By way of example, these drive rollers can be disposed at the delivery end directly beyond the planetary skew rolling mill and at an adequate radial distance from the work-material during the rolling operation. The drive rollers can be driven, constructed and journalled such that they are moved towards one another in a radial direction only when the work-material has passed through them and they need only withdraw the end portion of the shaft rod from the planetary skew rolling mill. Alternatively, other devices are conceivable for this purpose. Thus, for example, it is possible to construct the advancing means at the entry end of the planetary skew rolling mill such that it can also completely convey the shaft rods to the delivery end. The feed device then pushes the end of the shaft rod to an adequate extent out of the planetary skew rolling mill through the sizing pass opening from the entry end, so that the shaft rod can be removed from the rolling axis at the delivery end.

The removal of the shaft rods beyond the planetary skew rolling mill can be effected radially of the rolling axis, the shaft rods extending parallel to the rolling axis. For this purpose, the distance between the planetary skew rolling mill and the stretch-reducing rolling mill must be equal to the maximum length of the shaft rods plus an additional amount to provide a margin of safety. Since the speeds at which the work-material runs through the planetary skew rolling mill and the stretch-reducing rolling mill must be equal for the same period of time as the tubular bloom is being simultaneously processed in the two rolling mills, the next hollow ingot must only follow at a distance which gives sufficient time to withdraw the shaft rod of the previous hollow ingot from the rolling axis. In order to increase this period of time, it is possible to increase the run-through speed of the stretch-reducing rolling mill when the trailing end portion of the tubular bloom has just left the sizing pass opening of the planetary skew rolling mill.

It is particularly advantageous to provide beyond the planetary skew rolling mill a device for swinging the trailing end portion of the tubular bloom and the shaft rod inserted therein laterally out of the rolling axis after they have been delivered from the planetary skew rolling mill, and a drive device for withdrawing the shaft rod from the end portion of the tubular bloom. The cycle time is substantially shortened by this lateral swinging-out of the trailing end portion of the tubular bloom. The trailing end of the shaft rod can be removed from the rolling axis at an earlier instant than in the case of an accurately radial movement in which the shaft rod always extends parallel to the rolling axis. Although the tubular bloom is bent in a corresponding manner when the shaft rod is swung out laterally in this manner, any out-of-roundness thereby occurring does not have any disadvantageous results, since it is compensated for during the subsequent size-rolling or stretch-reducing rolling process. Since the work-material is still at rolling temperature and consequently can be more readily deformed, there is also no risk of damage to the work-material. The tubular bloom with the shaft rod located therein can be swung out in the same period of time required for inserting a fresh hollow ingot, thus achieving the maximum output of the planetary skew rolling mill.

If an embodiment is chosen in which the shaft rod in the planetary skew rolling mill runs from the entry end to the delivery end through the sizing pass opening, it must be ensured that deformation of the hollow interior of the ingot or bloom does not occur, that is to say, it must be ensured that a portion of the shaft rod is located within the sizing pass opening of the planetary skew rolling mill during the entire deforming operation, and that the shaft rod cannot pass completely through the sizing pass opening before the trailing end portion of the tubular bloom has been rolled. Therefore, it has proved to be advantageous for that end of the shaft rod trailing in the planetary skew rolling mill to have a thickened extension which serves as a stop for the hollow ingot and whose external diameter is larger than the internal diameter of the hollow ingot upstream of the planetary skew rolling mill and smaller than the sizing pass opening of the planetary skew rolling mill. A stop of this kind for the hollow ingot reliably prevents the shaft rod from assuming, during rolling in the planetary skew rolling mill, the higher delivery speed, resulting from the elongation occurring, of the leading longitudinal portion of the ingot shaped to form the tubular bloom, and thus prevents the shaft rod from being withdrawn from the trailing end portion of the part of the hollow ingot still to be rolled. Such a stop ensures that the shaft rod passes through the sizing pass opening of the planetary skew rolling mill at the same speed at which the portion of the hollow ingot still to be rolled enters the sizing pass opening. Consequently, a portion of the shaft rod is also still available for the trailing rear end of the portion of the hollow ingot. It is advantageous for the thickened extension to be in the form of a removable part, preferably a nut. In accordance with a further feature of the invention, this removable part can be mounted on the interior cooling tube of the shaft rod. Furthermore, it is possible for the removable part to be held by a holding device provided for the piercer which has previously been removed. There is then no need to provide an additional holder on the shaft rod, since a holding device has to be provided for the piercer. In the last-mentioned embodiment having a removable, thickened extension, it may be advantageous to remove the thickened extension from the shaft rod shortly before the extension enters the sizing pass opening, and to roll out the end portion of the hollow ingot over the trailing end portion, of appropriate length, of the shaft rod. Namely, in this embodiment, the diameter of the thickened extension can be larger than the inside diameter of the sizing pass opening, this having the advantage that the hollow ingot is more reliably supported by the thickened extension and cannot be pushed over this extension in an undesirable manner.

In a further development of the invention, the shaft rods, before they are used in the piercing mill, are provided with a lubricant which forms an inert atmosphere under the effect of heat. Bonding of the oxygen can then be effected by, for example, a combustible component of the lubricant. In this manner, scaling of the interior surface of the hollow ingot or of the tubular bloom is largely avoided.

The invention is further described, by way of example, with reference to the accompanying drawings, in which.

Figure 1:
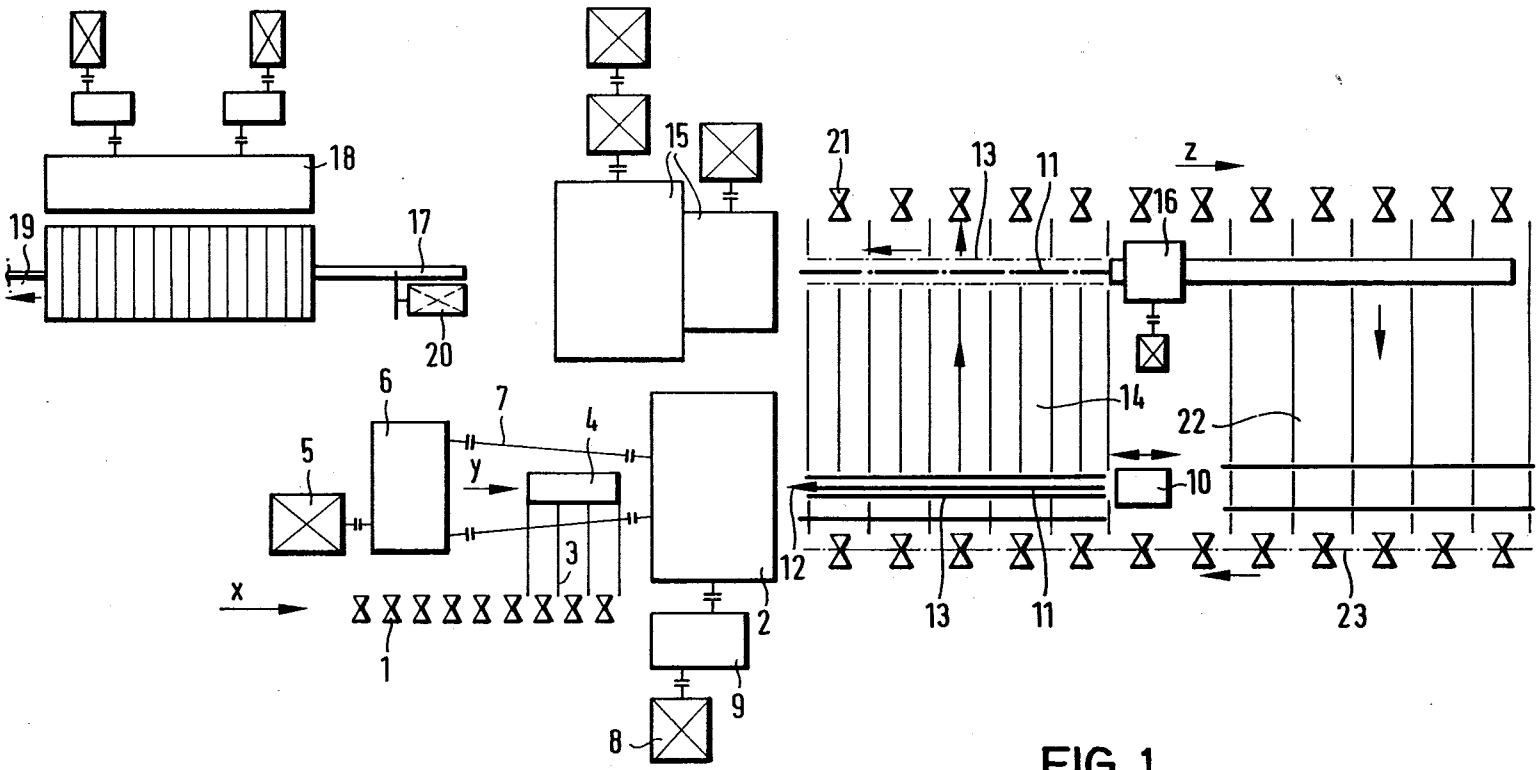
FIG. 1 is a diagrammatic plan view of a rolling mill plant with shaft rods remaining at the entry end upstream of a planetary skew rolling mill.

Referring to FIG. 1, a roller bed 1 conveys ingots in a hot state in the direction of the arrow x from a furnace (not illustrated) to a piercing mill 2. The ingots are centered at their leading end faces by a centering device (also not illustrated) and are placed onto a depositing table 4 of the piercing mill 2 by way of a transverse conveyor 3. The piercing mill 2 is in the form of a skew rolling mill whose skew rolls (not visible) are driven by a motor 5 by way of a transmission 6 and universal-joint shafts 7. Guide discs (also not visible) of the piercing mill 2 are driven by a second drive motor 8 by way of a transmission 9 and, together with the skew rolls, form the sizing pass opening of the piercing mill 2.

Each hot ingot is pushed in the direction of the arrow y into the sizing pass opening of the piercing mill 2 by a feed device (not illustrated). An abutment 10 also pushes a shaft rod 11 having a piercer 12 into the sizing pass opening of the piercing mill from the delivery end. The incoming ingot is then rolled onto the piercer 12 and onto the shaft rod 11, the ingot being elongated, provided with a central internal bore and thus becoming a so-called hollow ingot. A hollow ingot of this kind is designated 13 in FIG. 1. It is illustrated in a position in which it has already been withdrawn from the piercing mill 2 together with the shaft rod 11 by the abutment 10 which is constructed so as to be axially displaceable. The piercer 12, which is removably secured to the shaft rod 11, is removed at this instant.

The shaft rod 11 remains in the hollow ingot 13 and they are both conveyed by way of a transverse conveyor 14 to the entry end of a planetary skew rolling mill 15 where the shaft rod 11 is coupled to a feed device 16. The feed device 16 pushes the shaft rod 11, together with the hollow ingot 13 located thereon, until the leading end of the shaft rod 11 protrudes into the sizing pass opening of the planetary skew rolling mill 15 where the feed device 16 holds the shaft rod axially fixed in position. This enables the rolls of the planetary skew rolling mill 15 to engage the hollow ingot 13 and shape it to form a thinner-walled tubular bloom 17 of considerably greater length. The shaft rod 11 thereby serves as an internal tool. The planetary skew rolling mill 15 then gradually draws the hollow ingot 13 from the shaft rod 11 and conveys the tubular bloom 17 rolled therefrom to a stretch-reducing rolling mill 18 which is arranged downstream and in which the desired finished tube 19 is rolled from the tubular bloom 17. Since the end portions of the tubular blooms 17 are frequently very irregular, they are severed by flying shears 20 located between the planetary skew rolling mill 15 and the stretch-reducing rolling mill 18, so that the severed end portions can be scrapped.

At the instant shown in FIG. 1, the hollow ingot 13 has just emerged from the piercing mill 2 and in the next instant is conveyed to the planetary skew rolling mill 15 immediately after removal of the piercer 12. It will be appreciated that, at this instant, the region at the entry end of the planetary skew rolling mill 15 is free in order to be able to receive the hollow ingot 13 together with the shaft rod 11. Consequently, the shaft rod 11 and the hollow ingot 13 are also shown by dash-dot lines in front of the planetary skew rolling mill 15. When the hollow ingot 13 has been rolled down by the shaft rod 11, the latter is released from the feed device 16 and is ejected laterally onto a roller bed 21. The shaft rod 11 is conveyed in the direction of the arrow z to a second transverse conveyor 22 which also serves as a storage location and for maintenance of the shaft rods. When a fresh shaft rod 11 is required beyond the piercing mill 2, the fresh shaft rod is conveyed by a further roller bed 23 to a location directly downstream of the piercing mill 2 where the shaft rod is provided with a piercer 12 and is placed into the rolling axis of the piercing mill 2, so that a fresh hollow ingot 13 can be rolled onto it.

Figure 2:
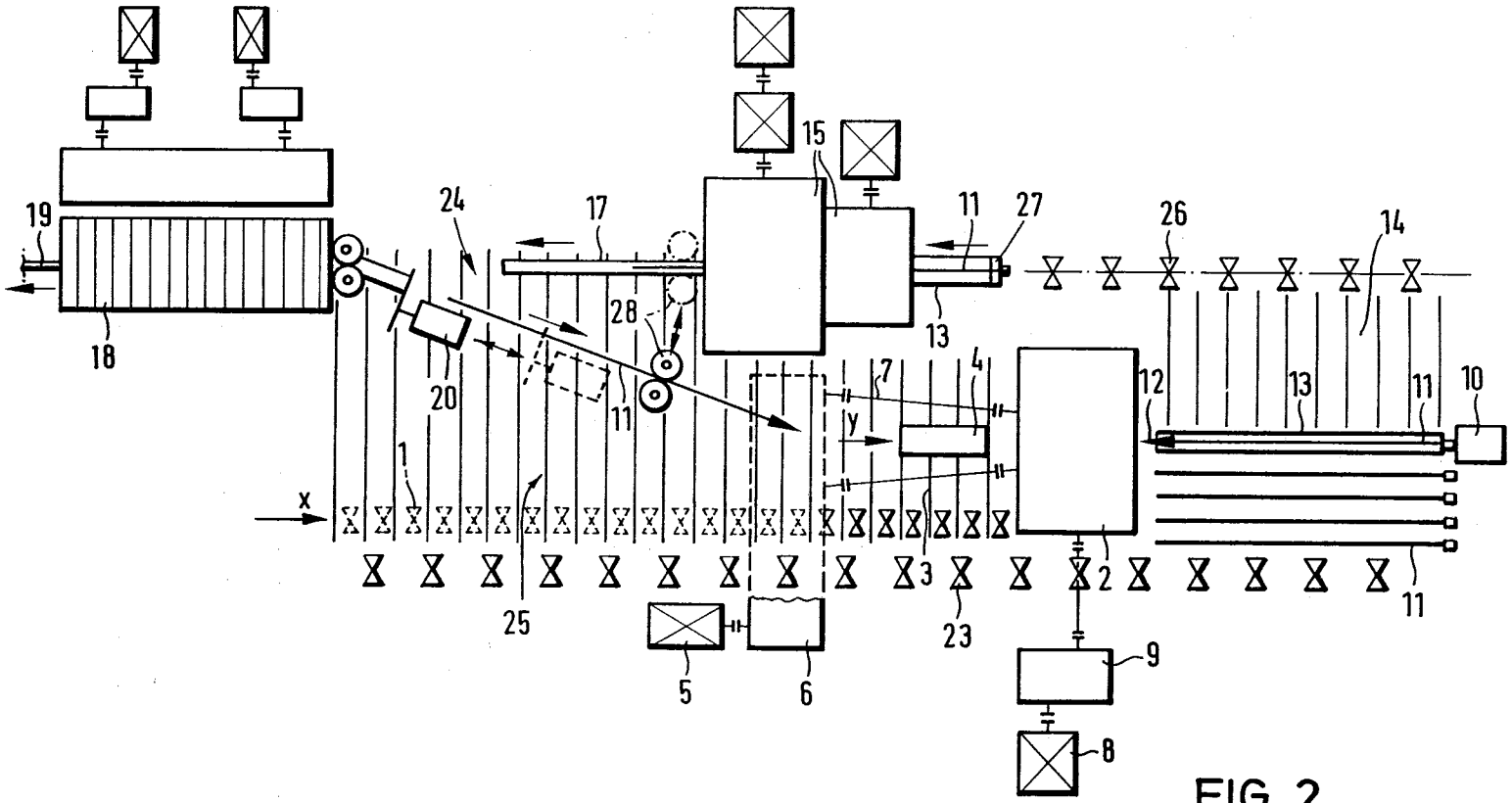
FIG. 2 is a plan view of a rolling mill plant with shaft rods running through a planetary skew rolling mill.

FIG. 2 shows another embodiment of the rolling mill plant which, however, has the same main parts which are consequently provided with the same reference numerals as in FIG. 1. The crucial difference between the embodiment of FIG. 1 and the embodiment of FIG. 2 is that, in the latter embodiment, the shaft rods 11 do not remain at the entry end of the planetary skew rolling mill 15, but run to the delivery end through the calibre sizing pass of the planetary skew rolling mill 15. Consequently, only the transverse conveyor 14 for the hollow ingots 13 containing the shaft rods 11 is located at the entry end of the planetary skew rollling mill 15, but no conveying devices for returning the empty shaft rods 11 to the piercing mill 2. Furthermore, the feed device 16, which has become superfluous, is not provided at the entry end of the planetary skew rolling mill 15. Instead, there is provided a driven roller bed 26.

However, in the embodiment of FIG. 2, a device generally designated 24 for the lateral swinging-out of the trailing portions of the tubular blooms is disposed at the delivery end of the planetary skew rolling mill 15. This device is located above the roller bed 1 coming from the furnace and the centering device (not illustrated) and has a swing-out table 25 which comprises spars located adjacent and parallel to one another and whose edge remote from the planetary skew rolling mill 15 is contiguous to a feed roller bed 23 for returning the shaft rods.

The mode of operation of this embodiment of the rolling mill plant is as follows:

In the same way as in the embodiment of FIG. 1, a centred ingot brought to rolling heat is conveyed by way of the low-lying roller bed 1 to the piercing mill 2 where the ingot is rolled onto the piercer 12 and onto a shaft rod 11 to which the piercer is attached. After removal of the piercer 12, the ingot is conveyed together with the shaft rod 11 into the rolling axis of the planetary skew rolling mill by way of a transverse conveyor 14. The feed force of the driven roller bed 26 is sufficient to introduce the hollow ingot 13 and the shaft rod 11 into the planetary skew rolling mill 15 where the hollow ingot is engaged by the rolls. The rear end portion of the shaft rod 11 has a stop 27 for the hollow ingot 13, so that the latter cannot be pushed beyond the rear end of the shaft rod 11 and, consequently, there is no relative movement between the shaft rod 11 and the hollow ingot 13 in the region of the entry end of the planetary skew rolling mill 15. However, matters are different at the delivery end. The delivery speed is higher than the entry speed owing to elongation of the reduced hollow ingot which has now become the tubular bloom 17. Consequently, the leading end portion of the tubular bloom 17 moves at a higher speed than the shaft rod 11 and enters the stretch-reducing rolling mill 18 and the leading end portion of the shaft rod 11 actually does not reach the stretch-reducing rolling mill 18. When the shaft rod 11, together with the trailing end portion of the hollow ingot 13 or rather of the tubular bloom 17, has finally passed through the planetary skew rolling mill 15, the trailing end portions of the tubular bloom 17 and of the shaft rod 11 are swung out laterally by the device 24 in the manner illustrated in FIG. 2. This is primarily effected by drive rollers 28 which assume the position, shown by dash-dot lines, during rolling of the leading portion of the work-material and which, as is illustrated, swing out of the rolling axis only upon delivery of the rear end portion of the tubular bloom 17 and shaft rod 11. Whilst the tubular bloom 17 continues to run into the stretch-reducing rolling mill 18, the two drive rollers 28 move radially towards one another until they engage the shaft rod 11 which is already free from the tubular bloom 17 in this region. The drive rollers 28 then draw the shaft rod 11 out of the trailing end portion of the tubular bloom 17. The trailing end portion of the tubular bloom 17 can then be cropped by the flying saw 20, whilst the shaft rod 11 is then immediately transferred to the roller bed 23 by the swing-out table 25 and is then returned to the entry end of the piercing mill 2 where it is maintained and serviced until it is put into use again.

Figure 3:
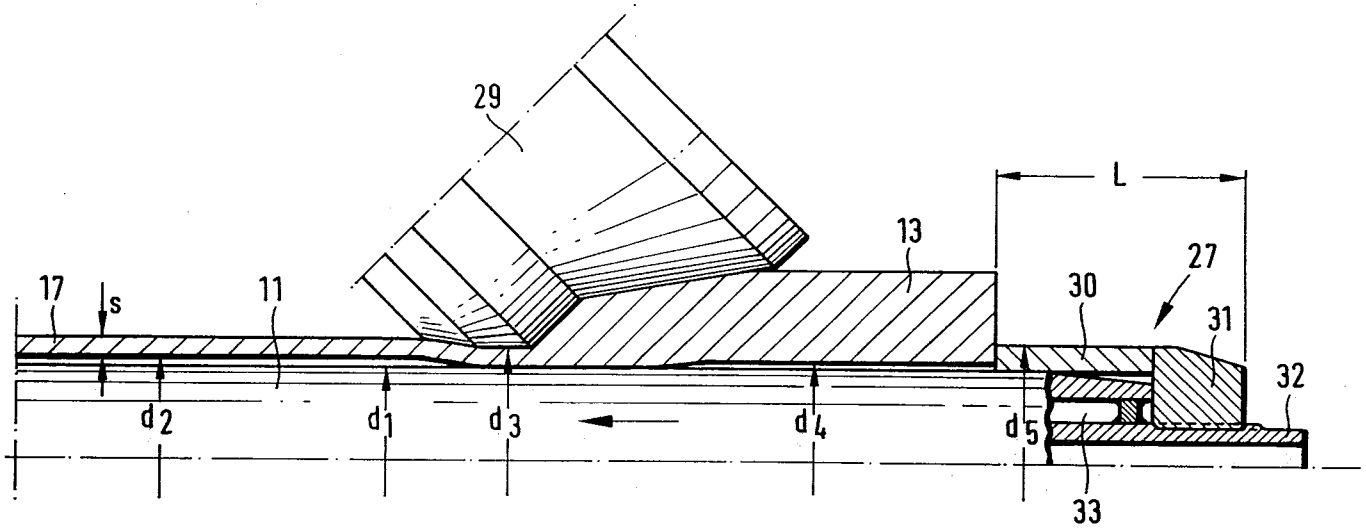
FIG. 3 shows, in section, the construction of the end portion of the shaft rod, and the work-material in the sizing pass of the planetary skew rolling mill.

FIG. 3 shows the trailing end portion of the shaft rod 11 when passing through the sizing pass opening of the planetary skew rolling mill 15 formed by rolls 29, only one half of one roll being illustrated. It will be clearly seen that the diameter $d_1$ of the shaft rod is smaller than the internal diameter $d_2$ of the tubular bloom and than the diameter $d_4$ of the hollow ingot 13. The work-material to be deformed is in contact with the shaft rod 11 only in the region of the rolls 29. It will be appreciated that the smallest sizing pass diameter $d_3$ must be larger than the external diameter $d_5$ of the stop 27, since the latter would otherwise damage the rolls 29. On the other hand, the external diameter $d_5$ of the stop 27 must be larger than the internal diameter $d_4$ of the hollow ingot 13, since the latter could otherwise slide over the stop 27.

The stop 27 comprises a plurality of parts, namely a spacer tube 30 and a nut 31 which is screwed onto a cooling tube 32 which is in turn welded in a bore 33 in the interior of the shaft rod 11. It is thereby possible rapidly to change the spacer tube 30 and also the nut 31 when hollow ingots 13 having different dimensions are to be rolled. It will be clearly seen that there is only a slight difference between the diameters $d_3$, $d_4$, and $d_5$. The use of a stop 27 of this kind is therefore enabled by the method in accordance with the invention, since, as is shown in FIG. 3, it is by using this method that the internal diameter $d_4$ can be kept so small. The internal diameter $d_4$ of the hollow ingot 13 cannot be kept as small as this in conventional rolling mill plant in which the shaft rod 11 has to be inserted into the hollow ingot 13 upstream of the planetary skew rolling mill 15, since difficulties otherwise occur when inserting the shaft rod 11, although they cannot occur in the rolling mill plant in accordance with the invention, since the shaft rod 11 is already located in the hollow ingot 13 remote from the piercing mill 2. Furthermore, the spacer tube 30 also has to serve for longitudinal compensation when hollow ingots 13 of different lengths are to be rolled on the same shaft rods 11. Thus, the dimension L is variable.

Figure 4:
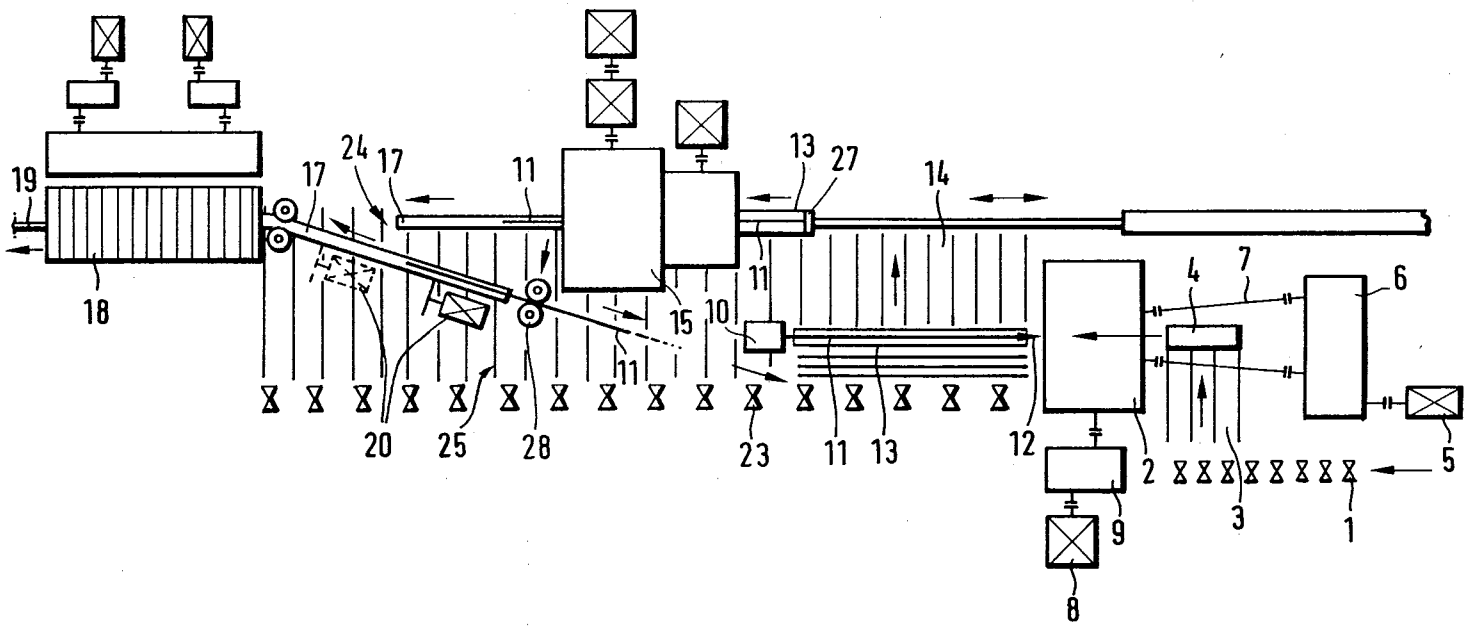
FIG. 4 is a plan view of a rolling mill plant similar to that illustrated in FIG. 2 but with only one holding device for the piercer and the stop for each shaft rod.

Alternatively, the stop 27 can be formed integrally with the shaft rod 11 in the embodiment of FIG. 2. Of course, this means that the paths of the hollow ingot 13 and of the shaft rod 11 must cross over one another, this being effected in the region of the swing-out table 25 in the embodiment of FIG. 2. FIG. 4 shows an embodiment of more simple construction. Here also, substantially the same reference numerals are used again. Of course, in this embodiment, crossing over of the paths of the hollow ingots 13 or of the tubular blooms 17 and the shaft rods 11 is advantageously avoided. Furthermore, the stop 27 in the form of, for example, a nut 31 (FIG. 3) is mounted on the same end of the shaft rod 11 as the piercer 12 and using the same holding. Thus, if the piercer 12 is removed downstream of the piercing mill 2 after the piercing operation, the nut 31, together with the spacer tube 30 if required, is at the same time mounted instead of the piercer 12 before the hollow ingot 13 is further conveyed to the planetary skew rolling mill 15 together with the shaft rod 11.

Figure 5:
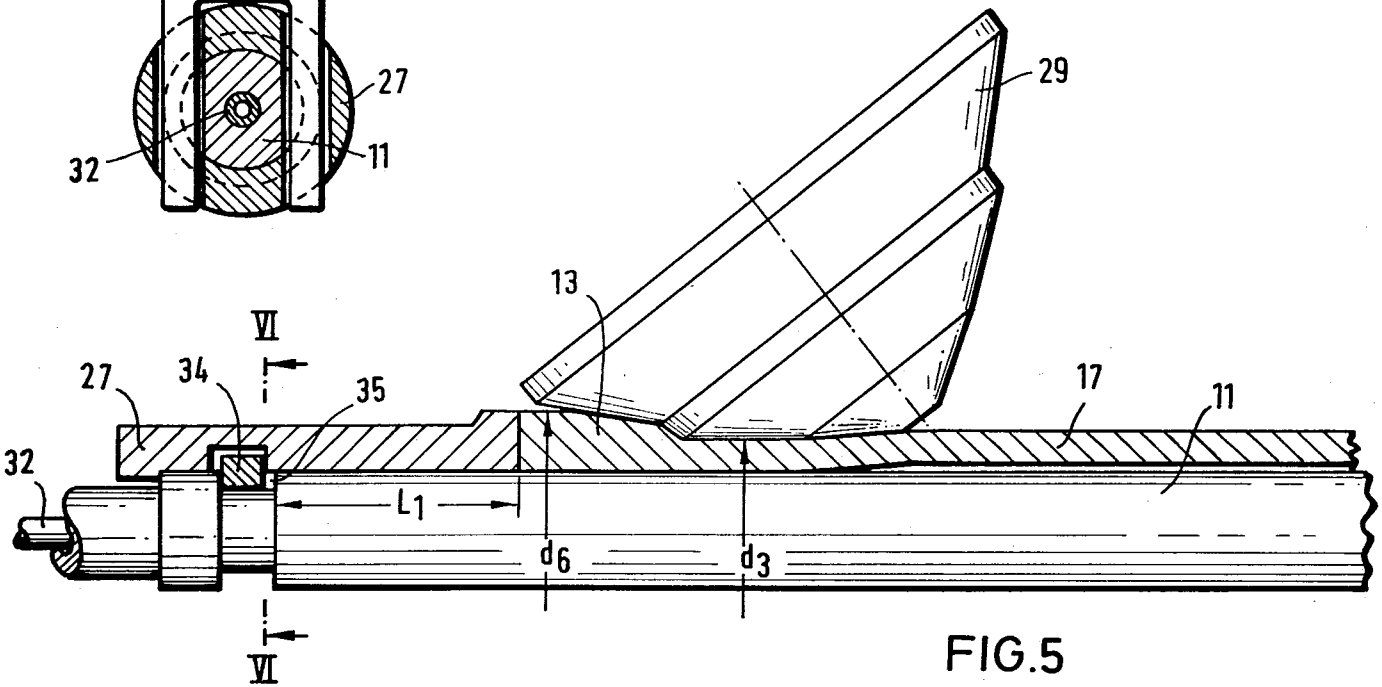
FIG. 5 shows a different construction of the end portion of the shaft rod similar to that of FIG. 3.
Figure 6:
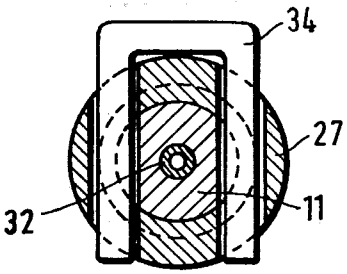
FIG. 6 is a section taken along the line VI—VI of FIG. 5.

FIG. 5 shows a shaft rod 11 having a stop 27 whose largest external diameter $d_6$ is equal to the external diameter of the hollow ingot 13 before rolling. The external diameter of the unrolled hollow ingot 13 is clearly greater than the diameter $d_3$ of the sizing pass opening formed by the rolls 29. Consequently, the stop 27 has to be removed from the shaft rod 11 as soon as it enters the region of the rolls 29. This is effected in a simple manner by withdrawing a securing member 34, whereupon the stop 27 can be pushed off the shaft rod 11 in an axial direction. The residual length $L_1$ of the shaft rod 11 is dimensioned such that the elongation of the tubular bloom 17, resulting from the still un-rolled residual volume of the hollow ingot 13, is smaller so that the tubular bloom cannot enter the region of the groove 35 in the shaft rod 11. FIG. 6 shows how the securing member 34 is constructed and inserted into holes in the stop 27 and into grooves 35 in the end of the shaft rod 11.

We claim:

1. A rolling mill plant for the manufacture of seamless tubes, comprising a piercing mill, a shaft rod having a removable piercer at one end and a trailing end at the opposite end, a planetary skew rolling mill and a sizing or stretch-reducing rolling mill are disposed one after the other, and are arranged so that each shaft rod used in the piercing mill is freed from its piercer and remaining in the hollow ingot with the trailing end exposed to serve as a mandrel rod in that ingot for the planetary skew rolling mill, conveying means being provided for returning the shaft rods from the planetary skew rolling mill to the piercing mill after the hollow ingot has been reduced in the planetary skew rolling mill, drive means at the exit end of the planetary skew mill engaging the end of the tube surrounding the shaft rod as they leave the planetary skew rolling mill on a pass line from the planetary skew mill to the stretch reducing mill moving transversely from the pass line and skewing the trailing rod end and surrounding tube end transversely of said pass line from the planetary skew rolling mill to the stretch-reducing mill so that the tube and trailing end of the shaft rod therein are positioned at an angle to the pass line, said drive means engaging said trailing end of the shaft rod and withdrawing the shaft rod from the tube end after said tube end is skewed transversely out of said pass line and the tube positioned at an angle to the pass line, whereby the tube is drawn through the stretch reduction mill free of the shaft rod.

2. A rolling mill plant as claimed in claim 1, in which the shaft rods together with the hollow ingot are movable through the planetary skew rolling mill from the entry end to the delivery end through the sizing pass opening and are returnable from the drive means spaced transversely from the pass line at the delivery end of the planetary skew rolling mill to the piercing mill by said conveying means.

3. A rolling mill plant as claimed in claim 2, in which the planetary skew rolling mill has a separate arrangement, such as drive rollers, for complete conveyance of the shaft rods towards the delivery end of the planetary skew rolling mill.

4. A rolling mill plant as claimed in claim 2, in which feeding means are provided at the entry end of the planetary skew rolling mill for feeding the work material and shaft rod into said mill and also for complete conveyance of the shaft rods towards the delivery end.

5. A rolling mill plant as claimed in any of claims 1 or 2 or 3 or 4 in which the shaft rod is provided at its trailing end in the planetary skew rolling mill with a thickened extension which serves as a stop for the hollow ingot and whose external diameter is larger than the internal diameter of the hollow ingot upstream of the planetary skew rolling mill but smaller than the sizing-pass opening of the planetary skew rolling mill.

6. A rolling mill plant as claimed in claim 5, in which the thickened extension is a removable part.

7. A rolling mill plant as claimed in claim 6, wherein the shaft rod has a spaced interior cooling tube and in which the removable part is mounted on said interior cooling tube of the shaft rod.

8. A rolling mill plant as claimed in claim 6, in which the removable part is held by a holding device provided for the piercer which has been previously removed.

9. A rolling mill plant as claimed in claim 6, wherein the thickened extension is a removable member which is removed from the shaft rod shortly before the said extension enters the sizing pass opening, and the end portion of the hollow ingot is rolled out by way of the trailing end portion, of appropriate length, of the shaft rod.

10. A rolling mill plant as claimed in claims 1 or 2 or 3 or 4, in which lubricating means are provided for the shaft rods downstream of the piercing mill, whereby said shaft rods are provided with a lubricant which forms an inert atmosphere under the effect of heat.

11. A rolling mill plant as claimed in claim 6 wherein holding means are provided to engage the removable part, said holding means being part of a holding device provided for the piercer which has been previously removed and whereby the thickened extension is removed from the shaft rod shortly before the said extension enters the sizing pass opening, and the end portion of the hollow ingot is rolled out by way of the trailing end portion, of appropriate length, of the shaft rod.

12. A rolling mill plant as claimed in claim 5 in which lubricating means are provided for the shaft rods downstream of the piercing mill, whereby said shaft rods are provided with a lubricant which forms an inert atmosphere under the effect of heat.

13. A rolling mill plant as claimed in claim 6 in which lubricating means are provided for the shaft rods downstream of the piercing mill, whereby said shaft rods are provided with a lubricant which forms an inert atmosphere under the effect of heat.

14. A rolling mill plant as claimed in claim 7 in which lubricating means are provided for the shaft rods downstream of the piercing mill, whereby said shaft rods are provided with a lubricant which forms an inert atmosphere under the effect of heat.

15. A rolling mill plant as claimed in claim 9 in which lubricating means are provided for the shaft rods downstream of the piercing mill, whereby said shaft rods are provided with a lubricant which forms an inert atmosphere under the effect of heat.

16. A rolling mill plant as claimed in claim 9 in which lubricating means are provided for the shaft rods downstream of the piercing mill, whereby the shaft rods are provided with a lubricant which forms an inert atmosphere under the effect of heat.

17. A rolling mill plant as claimed in claim 11 in which lubricating means are provided for the shaft rods downstream of the piercing mill, whereby said shaft rods are provided with a lubricant which forms an inert atmosphere under the effect of heat.

* * * * *

UNITED STATES PATENT AND TRADEMARK OFFICE

CERTIFICATE OF CORRECTION

PATENT NO. : 4,571,970

DATED : February 25, 1986

INVENTOR(S) : HERMANN MOLTNER, KARL-HANS STAAT

It is certified that error appears in the above-identified patent and that said Letters Patent is hereby corrected as shown below:

Column 7, line 23, after mill, insert --15--.

Signed and Sealed this

*Tenth* Day of *June 1986*

[SEAL]

*Attest:*

DONALD J. QUIGG

*Attesting Officer*

*Commissioner of Patents and Trademarks*